US006322184B1

(12) United States Patent
Brenner et al.

(10) Patent No.: US 6,322,184 B1
(45) Date of Patent: Nov. 27, 2001

(54) METHOD AND APPARATUS FOR IMPROVED SWATH-TO-SWATH ALIGNMENT IN AN INKJET PRINT ENGINE DEVICE

(75) Inventors: James M. Brenner, Vancouver; Steven H. Walker, Camas; Allan D. Donley, Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/309,092

(22) Filed: May 10, 1999

(51) Int. Cl.[7] ..... B41J 23/00
(52) U.S. Cl. ..... 347/14; 347/37
(58) Field of Search ..... 347/9, 14, 19, 347/37; 406/124.04, 279, 705, 705.1

(56) References Cited

U.S. PATENT DOCUMENTS

| | | | | |
|---|---|---|---|---|
| 4,786,803 | | 11/1988 | Majette et al. | 250/237 G |
| 4,789,874 | | 12/1988 | Majette et al. | 346/140 R |
| 4,794,411 | | 12/1988 | Taub et al. | 346/140 R |
| 5,097,189 | * | 3/1992 | Ito et al. | 318/685 |
| 5,262,797 | | 11/1993 | Boeller et al. | 346/1.1 |
| 5,289,208 | | 2/1994 | Haselby | 346/140 R |
| 5,414,453 | | 5/1995 | Rhoads et al. | 347/8 |
| 5,448,269 | | 9/1995 | Beauchamp et al. | 347/19 |
| 5,467,115 | | 11/1995 | Childers | 347/47 |
| 5,527,121 | | 6/1996 | Santon | 400/323 |
| 5,644,343 | | 7/1997 | Allen | 347/17 |
| 5,669,721 | | 9/1997 | Santon et al. | 400/279 |
| 5,685,074 | | 11/1997 | Pan et al. | 29/890.1 |
| 5,757,400 | * | 5/1998 | Hoisington | 347/40 |
| 5,889,534 | * | 3/1999 | Johnson et al. | 347/19 |
| 5,936,645 | * | 8/1999 | Niikura et al. | 347/14 |

* cited by examiner

*Primary Examiner*—John Barlow
*Assistant Examiner*—Craig A. Hallacher
(74) *Attorney, Agent, or Firm*—Jerry R. Potts

(57) ABSTRACT

In an inkjet printing machine, an ink drop error correction apparatus includes a position extrapolator that is responsive to conventional position encoder pulses and uses a second order polynomial equation to compensated for ink drop distortions induced at higher carriage velocities of at least 25 inches per second for generating a series of nozzle firing sub-pulses that account for different carriage velocities. A fire pulse generator responsive to the sub-pulses further adjusts the firing time of the printing machine nozzles to correct for the carriage velocity induced ink drop positional errors for both non constant and constant carriage velocity conditions.

11 Claims, 8 Drawing Sheets

METHOD AND APPARATUS FOR IMPROVED SWATH-TO-SWATH ALIGNMENT IN AN INKJET PRINT ENGINE DEVICE

RELATED APPLICATIONS

This application is related to U.S. patent application Ser. No. 09/162,369 entitled "Method and Apparatus for Compensating for Variations in Printhead-To-Media Spacing and Printhead Scanning Velocity In An Ink-Jet Hard Copy Apparatus," and U.S. Ser. No. 09/161,798 entitled "Apparatus and Method for Correcting Carriage Velocity Induced Ink Drop Positional Errors" filed concurrently on Sep. 28, 1998.

FIELD OF INVENTION

This invention relates generally to machines and procedures for printing text or graphics on printing media such as paper, transparency stock, or other glossy media; and more particularly to such a machine and method that constructs text or images from individual marks created-on the printing medium, in a two-dimensional pixel array, by a pen or other marking element or head that scans across the medium. The invention is particularly related to printers, copiers, facsimile, and other similar print engine devices that operate by the thermal-inkjet process which discharges individual ink droplets as a printhead travels in close proximity across a print medium and a ink drop correction method for compensating for different printhead velocities.

BACKGROUND OF THE INVENTION

The operation of any scanning-head device in traversing or moving the printhead across the medium to discharge ink droplets does present some obstacles to precise positioning of the printed marks, and also to best image quality. In order to describe these obstacles it will be helpful first to set forth some of the context in which these systems operate.

In many printing devices, position information is derived by automatic reading of graduations along a scale or so-called "encoder strip" (or sometimes "code strip") that is extended across the medium. The graduations typically are in the form of opaque lines marked on a transparent plastic or glass strip, or in the form of solid opaque bars separated by apertures formed through a metal strip.

Such graduations typically are sensed electro-optically to generate an electrical waveform that may be characterized as a square wave, or more rigorously a trapezoidal wave. Electronic circuitry responds to each pulse in the wave train, signaling the pen-drive (or other marking-head-drive) mechanism at each pixel location-that is, each point where ink can be discharged to form a properly located picture element as part of the desired image.

These data are compared, or combined, with information about the desired image triggering the pen or other marking head to produce a mark on the printing medium at each pixel location where a mark is desired. As will be understood, these operations are readily carried out for each of several different ink colors, for printing machines that are capable of printing in different colors.

In addition to this use of the encoder derived signal as an absolute physical reference for firing the pens, the frequency of the wave train is ordinarily used to control the velocity of the pen carriage. Some systems also make other uses of the encoder signal such as, for example, controlling carriage reversal, acceleration, mark quality, etc. in the end zones of the carriage travel, beyond the extent of the markable image region.

Now, standardized circuitry for responding to each pulse in the encoder derived signal is most straightforwardly designed to recognize a common feature of each pulse. Thus some circuits may operate from a leading (rising) edge of a pulse, others from a trailing (falling) edge-but generally each circuit will respond only to one or the other, not both.

Such circuits have been developed to a highly refined stage. Accordingly it is cost-effective and otherwise desirable to employ one of these well refined, already existing circuits relative to such compensation; however, in adapting such a preexisting design, several problems arise relative to encoder dimensional tolerances and ink droplet time of flight from nozzle to print medium. Each of these problems will now be examined in greater detail.

(a) Encoder dimensional tolerances

As noted earlier, the position of the pen carriage unit is monitored utilizing a detector that reads a position encoder. In this regard, encoder-reading circuitry processes the encoder reader data to produce pulses each time the carriage unit moves a fixed distance, usually on the order of 1/75th or 1/150th of an inch. However, the drop placement on the print medium must be placed on spatial boundaries that are much smaller, such as down to 1/4800th of an inch or even smaller. Unfortunately, the position encoder is not nearly this precise. Moreover, other problems are associated with the encoder dimensional tolerances. For example, the encoder-reading circuitry is triggered from the falling edges of the initial encoder-derived wave train. The alternating opaque markings and transparent segments (or solid bars and orifices) of the encoder strip are arranged in time alignment with the signals that result from reading of those features by a transmissive optical emitter/detector pair.

It will be understood that, in selecting the point at which a mark should be made, it is possible to make allowance for the nominal width of the transparent segment. For example, the firing of a pen could be delayed by a period of time automatically calculated from the nominal width of the transparent segment divided by the carriage velocity. Although both these pieces of information are available during operation of the system, the results of this method would be unsatisfactory because of preferred manufacturing procedures for creation of the encoder strip. These procedures arise from economics related to dimensional requirements, as follows.

Thus, in making an encoder strip, the dimension, which is most important to hold to highest precision, is the overall periodicity of the alternating opaque bars and transparent segments, i.e., the periodicity dimension that gives rise to a full wavelength of the wave train. The two internal dimensions of each mark-and-transparent-segment pair, namely, the length of the bar and the length of the transparent segment, are much less important.

In a unidirectional printing machine, only the distance between falling edges (or alternately rising edges) has any importance, provided only that (1) the distance from each falling edge to its next associated rising edge is great enough to permit the sensing apparatus to recognize the falling edge; and (2) the distance from each rising edge to its next associated falling edge is great enough to permit the sensing apparatus to reset itself in preparation for sensing the falling edge.

More specifically, the dimensional accuracy of the encoder-strip features are plus-or-minus only one percent for the full periodic pattern width, but plus-or-minus ten to twenty percent for the opaque bar width alone. While it would be entirely possible to manufacture an encoder strip with much finer precision in the internal dimensions just mentioned, an encoder strip so made would be substantially more expensive.

(b) Time-of-Flight

A certain amount of time elapses between the issuance of a mark-command pulse to a print head and the mark actually being created on the printing medium. For instance, in an inkjet printer, some time elapses between: the issuance of a fire-command pulse, approximately at an encoder-wave train falling edge, to a pen nozzle and the instant when a resulting ink drop actually reaches the medium.

During this time, however, the carriage and pen continue to move across the printing medium, and, in the case of an inkjet device, so does the ink drop, even after leaving the pen. The initial velocity component of the drop along the scanning axis or dimension, when scanning forward is very closely equal to the carriage velocity. This velocity likely decreases while the drop travels in the orthogonal axis or dimension toward the printing medium, but nevertheless, some forward movement or displacement of the ink drop along the scanning axis does occur before the drop reaches the medium to form an ink spot.

(c) Pen Datum in Carriage (d) Drop Trajectory and Velocity (e) Tail Distortion

Another problem associated with time-of-flight effects is dot tail distortion created when a high-speed ink droplet impacts a stationary print medium. In this regard, at lower carriage velocity speeds there is no or substantially little visible dot distortion due to time-of-flight impact. However, as will be explained hereinafter in greater detail, as the velocity of the carriage unit is increased to achieve a higher throughput, substantial dot distortion can result at the higher carriage velocity speeds.

Therefore it would be highly desirable to have a new and improved system that corrects for variations in the ink drop flight path due to different carriage velocity, and that also adjusts the dot formation due to the increased carriage velocity rates. Such a new an improved system should also accurately determine ink droplet positioning to ensure that such droplets hit the medium at a proper position.

SUMMARY OF THE DISCLOSURE

The present invention introduces such refinement. The invention has several facets or aspects, which can be used independently, although for the best advantages of the invention all the aspects are preferably used together.

In preferred embodiments of a first of its facets, the present invention takes into account the variation in the ink drop shape due to different carriage velocities and determines extrapolated positions at which drops are fired to account for the speed of the pen carriage. With respect to this later factor the present invention includes in an inkjet printing machine, an ink drop error correction apparatus having a position extrapolator that is responsive to conventional position encoder pulses and that utilizes a second order polynomial equation to compensate for ink drop distortions induced at higher carriage velocities of at least 25 inches per second. The error correction apparatus facilitates the generating of a series of nozzle firing sub-pulses that account for different carriage velocities. A fire pulse generator responsive to the sub-pulses further adjusts the firing time of the printing machine nozzles to correct for the carriage velocity induced ink drop positional errors for different constant carriage velocity conditions.

BRIEF DESCRIPTION OF THE DRAWINGS

The above mentioned features of this invention and the manner of attaining them will become apparent, and the invention itself will best be understood by reference to the following description of the embodiments of the invention in conjunction with the accompanying drawings, wherein.

BEST MODE FOR CARRYING OUT THE INVENTION

Figure 1:
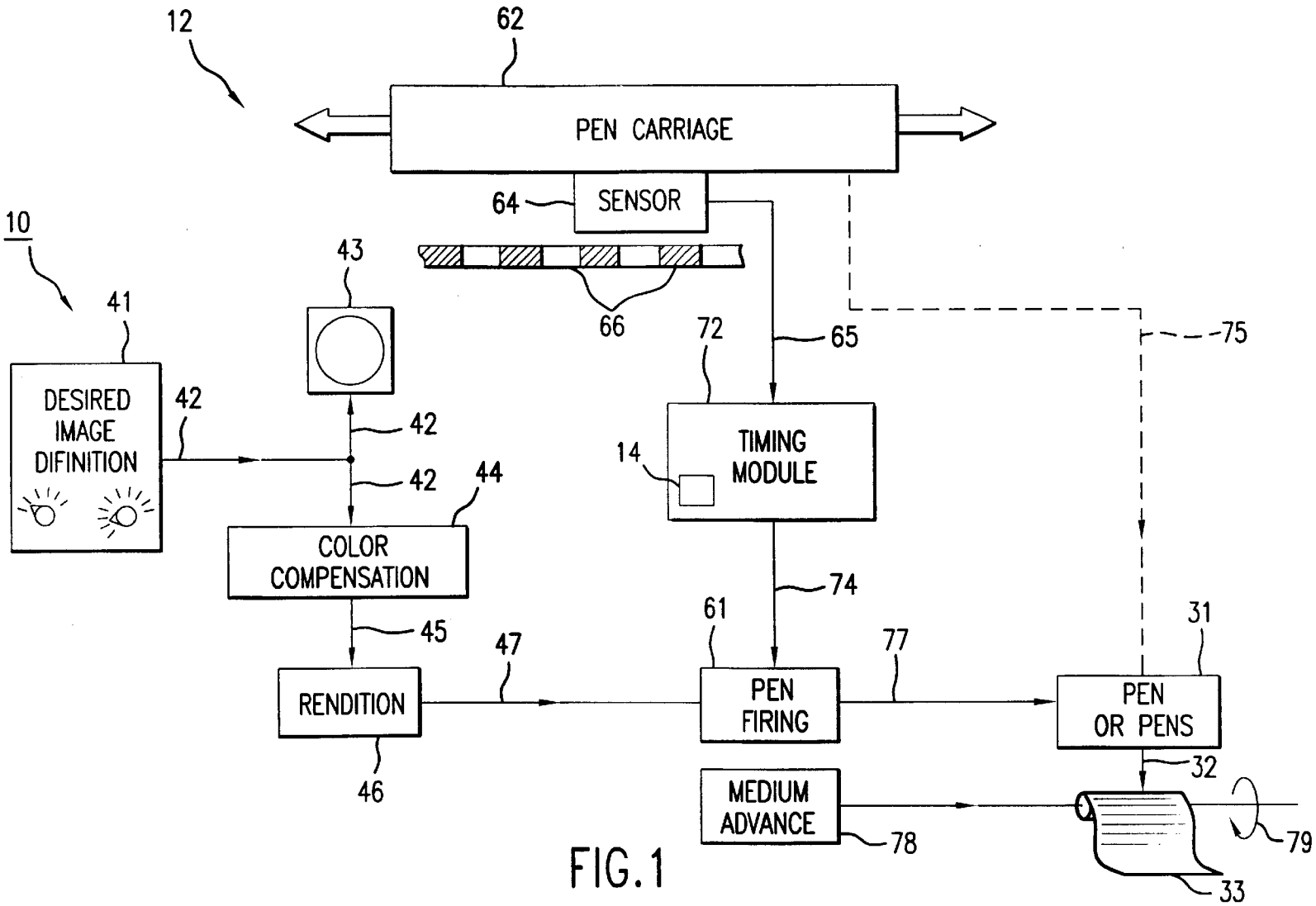
FIG. 1 is generalized block diagram of a document reproduction system having a printing system, which is constructed in accordance with the present invention.

Referring now to the drawings and more particularly to FIG. 1 thereof, there is illustrated a document reproduction system 10 that is constructed in accordance with the present invention. The new and improved document reproduction system 10 includes a printing system 12 that automatically corrects for carriage velocity induced ink drop position errors in accordance with a novel correction method of the present invention.

Before discussing the document reproduction system 10 in greater detail, it may behoove the reader to consider certain prior art solutions. In this regard, one correction approach that has been relatively successful has been to compensate ink drop placement for varying velocity speeds using a linear equation approach based upon an assumed alignment at some given speed, such as a speed of 20 inches per second. In this approach, alignment is necessary since there are two vector components ($V_C$ and $V_d$) in the flight trajectory of an ink droplet as best seen in FIG. 3. This can be compared to dropping bombs from an airplane traveling at a given velocity or speed, where the bombardier must allow for the forward movement of the aircraft in an attempt to direct a bomb to a desired target. That is, in order to compensate for the carriage velocity in an associated print engine, the trajectory path of an ink drop released from an associated print head nozzle must be corrected. One current solution is based on the graphical representation provided in FIGS. 2–4.

In FIG. 3, the correction model ignores higher order effects such as wind resistance, gravity, humidity to name a few that could otherwise be considered. Thus, if it is assumed the flight path of a droplet of ink follows a straight line path as indicated generally at 14, one can derive a simple equation:

$$X_O=V_C[X_P/V_d] \quad \text{Equation No.: 1}$$

Where $X_O$=the displacement distance traveled by the ink droplet due to the carriage traveling at a carriage velocity of ($V_C$)

If it is further assumed that the drop velocity $V_D$ of the ink droplet and the vertical drop path distance $X_{PPS}$ are both constant for a given carriage and pen structure, Equation 1 can be further simplified as shown in Equation 2:

$$X_O=KV_C \text{ where } K=X_{PPS}/V_d \quad \text{Equation No.: 2}$$

Figure 4:
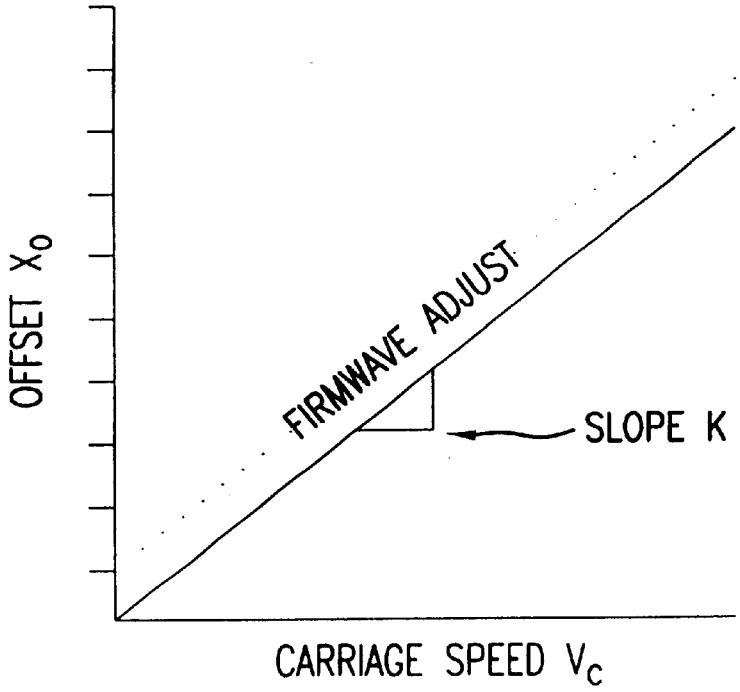
FIG. 4 is a graphical representation of a straight line equation where the straight line has a slope of K and is indicative of an offset relative to carriage velocity.

Those skilled in the art will appreciate that equation 2 is an equation that defines a straight line 16 having a slope K as illustrated in FIG. 4. Utilizing this base equation information, it can be concluded that when the carriage velocity $V_C$ is zero, then the traveled horizontal trajectory distance $X_O$ traveled by an ejected ink droplet will also be zero.

Using the base equation information from equation 2, those skilled in the art will further appreciate that by using a given the slope value K and a single point on the defined line, a compensation equation can be developed based on an alignment test that corrects for any carriage velocity speed ($V_C$) within a given range, of typically between about 5 inches per second and about 40 inches per second. In the prior art solution then, compensation is effected by adding a constant value (k) to shift the line 16 up and down with the assumption that the slope K is constant for all pen and carriage types.

While this approach may produce satisfactory results in certain situations, it must be recognized that the compensation is limited to correcting for only one point on the line 16 where the velocity of the carriage is set at about 20 inches per second. It should be understood by those skilled in the art that an implicit assumption in the foregoing model is that the optical center of the ink droplet remains at the target location for the given carriage speed ($V_C$).

Figure 7A:
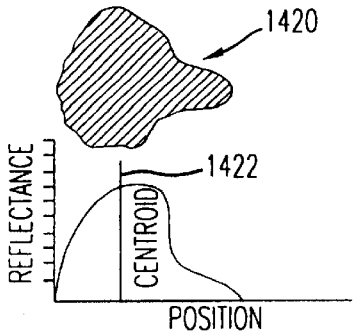
FIG. 7 is a diagrammatic representation of dot distortions induced by a carriage unit traveling at high and low carriage velocity speeds.
Figure 7B:
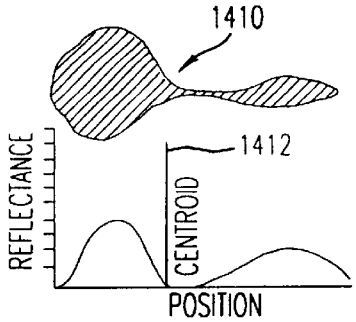

The above-mentioned assumption limitation however begins to break down when the carriage velocity ($V_C$) is equal to or greater than about 25 inches per second to about 30 inches per second. That is, once a greater carriage velocity of $V_C$>25 inches per second is achieved, the optical center of the ink droplets begin to move resulting in a visibly noticeable tail as best seen in FIG. 7. In short then, while the above described approach may be satisfactory at lower carriage velocity speeds, the prior art model fails to provide a satisfactory result at the higher carriage velocities as ink droplets become significantly misaligned when the carriage velocity is about 25 inches per second or greater.

Figure 6:
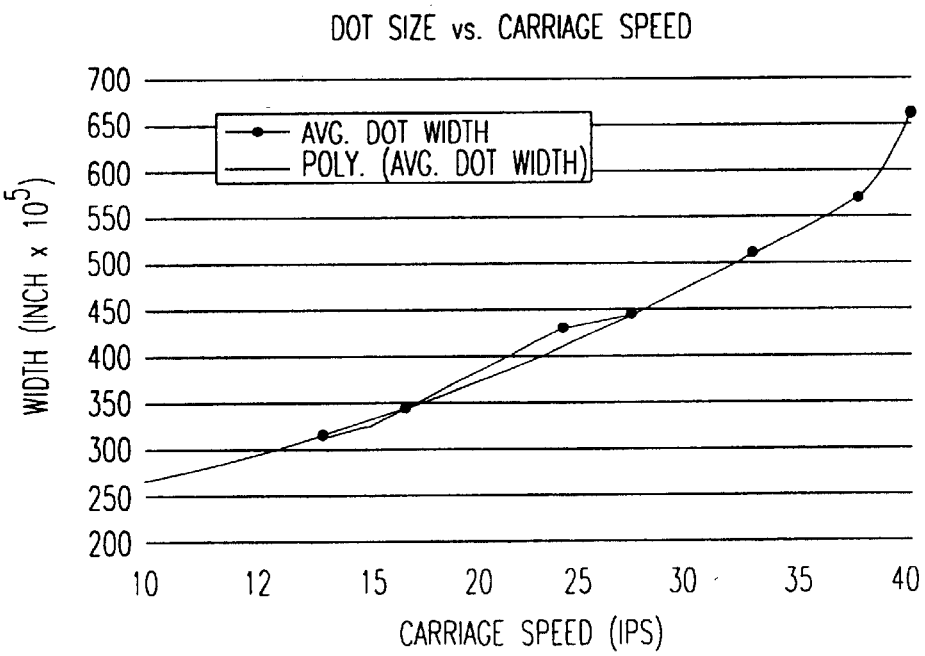
FIG. 6 is a diagrammatic representation of ink droplet width effected by different carriage velocity speeds.

Considering now the dot shape compensation method of the present invention, with reference to FIG. 6, it will be recognized by those skilled in the art that as carriage velocity ($V_C$) increases, the average width of the dot produced on the receiving print medium also increases. The dot size versus carriage speed data illustrated in FIG. 6, demonstrates a best-fit second order polynomial for a large sample of drops taken at eight (8) substantially different carriage velocity speeds.

It can be shown then, regardless of an exact fit, the correlation between dot size and carriage speed is significant. Referring to FIG. 7, it can be clearly seen that a dot 1410 created at a carriage speed of 40 inches per second is significantly wider than a dot 1420 created at a carriage speed of 20 inches per second. This is important as the optical center of the dot shifts, as the dot size becomes larger. FIG. 7 further illustrates a pair of centroids at 1412 and 1422 respectively that are indicative of the reflectance integral as measured with an optical sensor. The centroids 1412 and 1422 are the optical centers of each of the respective droplet after impact with the print medium. Examples of such optical sensors are disclosed in U.S. patent application Ser. No. 08/885,486 entitled "Monochromatic Optical Sensor," now U.S. Pat. 6,036,298, and U.S. Pat. application Ser. No. 09/161,798 entitled "Apparatus and Method For Correcting Carriage Velocity Induced Ink Drop Positional Error," filed Sep. 28, 1998.

To compensate for the optical center shift, the present inventive method considers taking an extra data point at a higher carriage speed for alignment purposes. That is, one data point is taken at a carriage velocity speed of 20 inches per second and another or second data point is taken at a carriage velocity speed of 40 inches per second. The method then develops, by the application of a least squares algorithm that allows for dot shape growth at higher carriage speeds, an approximation curve wherein it is assumed that the carriage velocity ($V_C$) and the displacement distance ($X_O$) are both zero.

Figure 8:
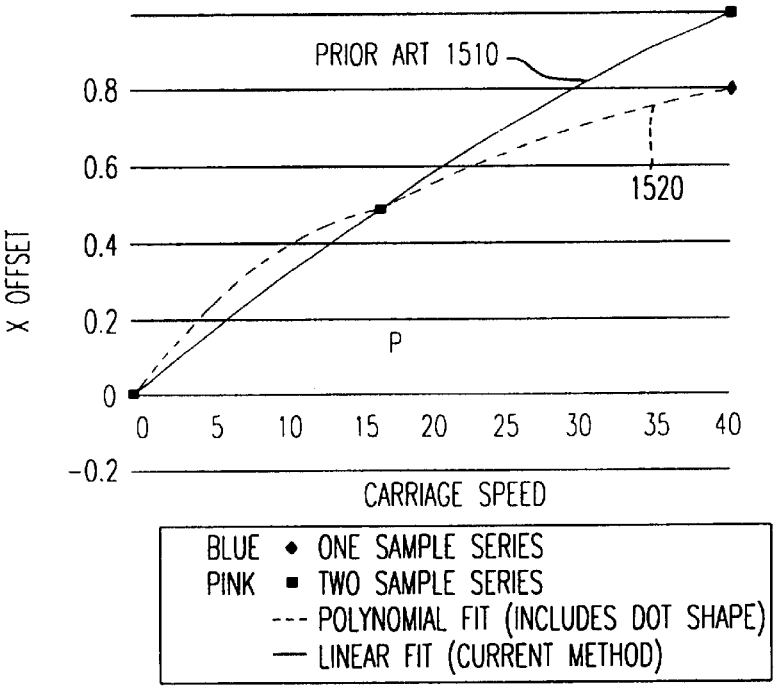
FIG. 8 is a graphical representation of two different compensation models for correcting for different carriage velocity speeds.
Figure 10:
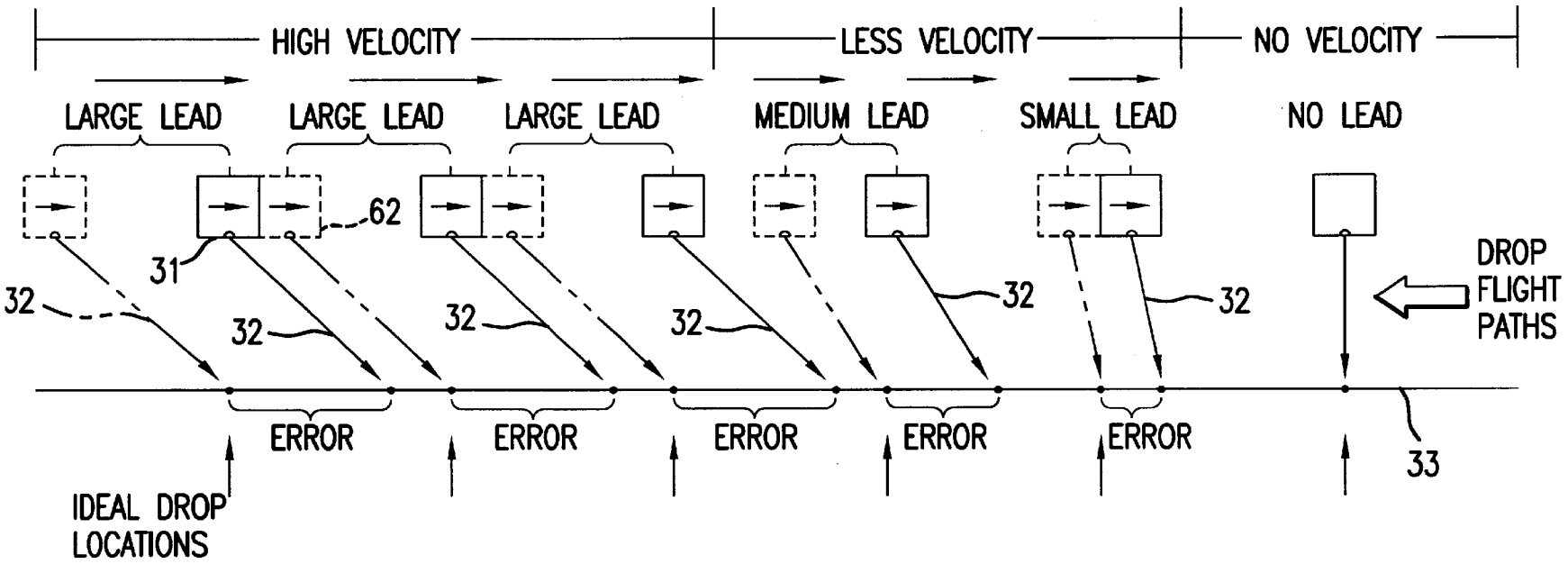
FIG. 10 is another graphical representation of a first order velocity position profile of a carriage unit of FIG. 1, illustrating a non-constant velocity sweep line.

FIG. 8 illustrates the difference in flight time compensation between a linear method algorithm plot line 1510 and the dot shape compensation algorithm plot 1520. FIG. 10 illustrates the lead-time that must be effected to compensate for the higher carriage velocity model.

It should be understood by those skilled in the art that an alternative approach algorithm would be to approximate the plot 1520 utilizing a piecewise linear approximation of the plot 1510 at carriage velocity speeds of between about 0 inches per second and 20 inches per second and another piecewise linear approximation of the plot 1520 at carriage velocity speeds of between about 20 inches per second and about 40 inches per second. This approach approximates a polynomial implementation without the necessity of additional hardware or firmware to support a real time polynomial calculation.

Figure 11:
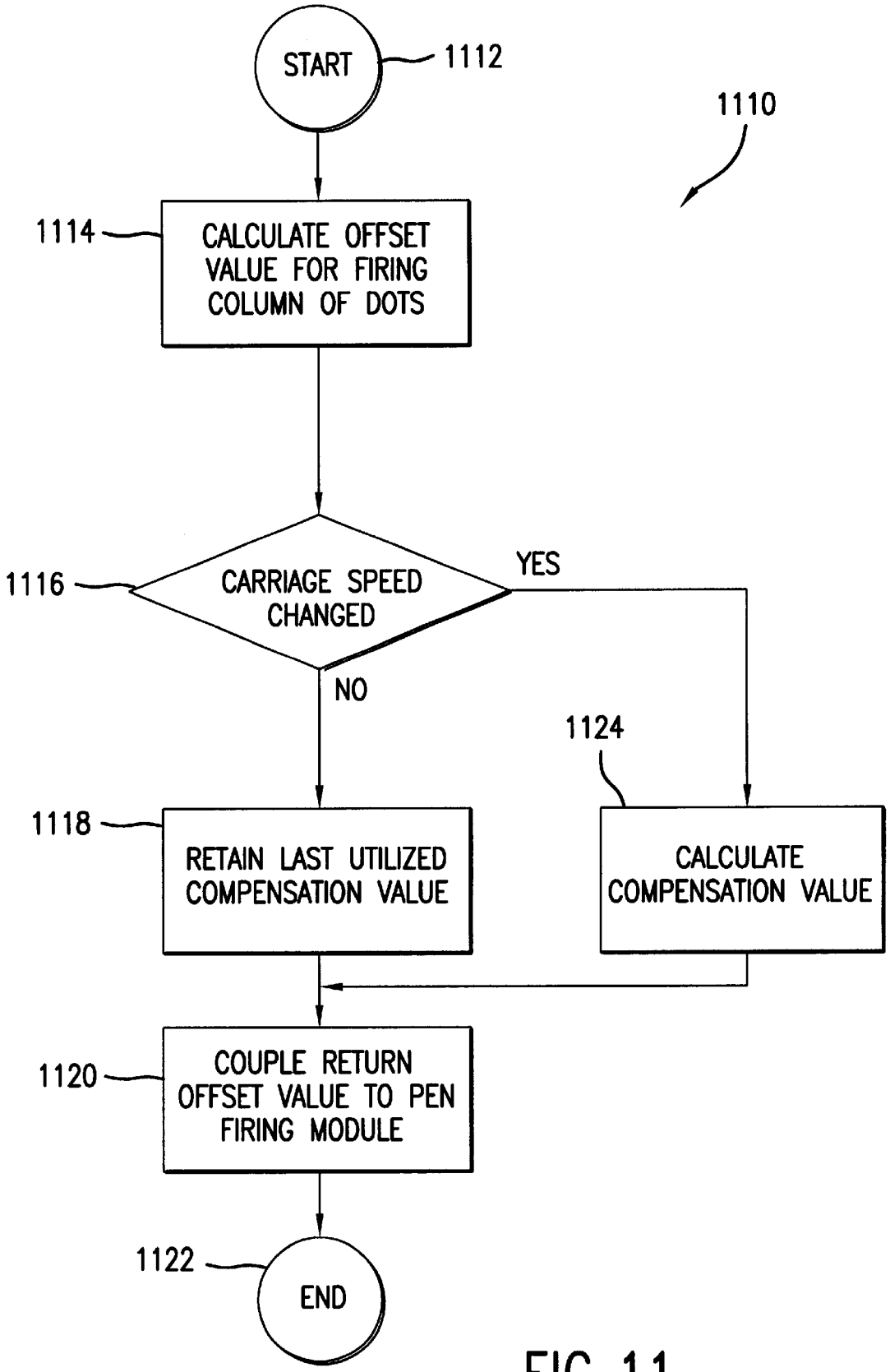
FIG. 11 is a flowchart illustrating an example algorithm for calculating a polynominal offset value.

Considering now the operation of the system 10 relative to a new an improved linear alignment algorithm 1110 in greater detail with reference to FIG. 11, the algorithm 1100 begins from a start instruction 1112 and proceeds to a command instruction 1114 that causes the system 10 to calculate an offset value for firing a column of ink droplets. The algorithm then proceeds to a decision instruction 1116 to determine whether the current carriage speed is different than the carriage speed when a previous dot firing pulse was active. If the carriage speed or velocity has not changed, indicating that the carriage is either stopped or is traveling at a constant velocity, the program proceeds to a command instruction 1118 that causes the system 10 to retain the last calculated compensation value. The program then advances to an command instruction 1120 that causes the offset value to be sent to facilitate pen firing at a desired offset rate. The program then goes to an end command 1222.

If at the decision instruction 1116 a determination is made that the carriage speed has changed, the algorithm proceed to a command instruction 1124 to calculate a compensation value based on the following polynominal equation, as an example:

$$Y=0.0003x^2+0.03x$$

Where y=offset in 600ths and

Where x=carriage speed in inches per second

It should be understood that the actual polynominal equation that would be applied would be dependent upon the actual printer system in which the algorithm was to be implemented.

After calculating the compensation value, the algorithm advances to the command 1120 and proceeds as described previously.

The system 10 generally includes a printing system 12 coupled to an input stage 41 having an output indicated generally at 42. The input stage 41 may include manual controls (not shown) to provide information defining the desired image. The output 42 of the input stage 41 may proceed to a display 43 if desired to facilitate esthetic or other such choices; and, in the case of color printing systems, to a color-compensation stage 44 having an output 45. The color-compensation stage 44 corrects for known differences between characteristics of the display 43 and/or input source 41 system relative to the printing system 12.

The printing system 12 includes a pen carriage unit 62 having one or more pen cartridges 31 mounted therein for ejecting droplets of ink 32 onto a print medium 33. An electro-optical position sensor 64 mounted to the carriage unit 62 cooperates with an encoder strip 66, a timing module 72, and a pen firing control circuit 61 to help facilitate determining carriage unit position, velocity and acceleration for pen firing purposes as well be explained hereinafter in greater detail.

The output 45 from the compensator 44 is coupled to a rendition stage 46 having an output 47. The rendition stage 46 helps determine how to implement the desired image at the level of individual pixel-position printing decisions for each color, if applicable. The resulting output 47 from the rendition stage 46 is directed to the pen firing control circuit 61 that determines when to direct a firing signal 77 to each pen cartridge 31.

The pen discharged ink droplets 32 (FIGS. 1, 3, and 7) form images on paper or some other printing medium, such as the print medium 33. Meanwhile typically a medium-advance module 78 provides relative movement 79 of the medium 33 in relation to the pen 31.

To improve the output quality (accuracy) when printing, the novel dot shape correction method employs a polynomial equation technique implemented at the silicon level on a custom integrated circuit 14 forming part of the timing module 72 that will be described hereinafter in greater detail. The integrated circuit 14 within the timing module 72 causes an estimated polynomial equation of at least the second order to approximate the dot shape or width resulting from a cartridge carriage unit 62 sweeping pen cartridges 31 above the print medium 33 at different velocities.

Figure 2:
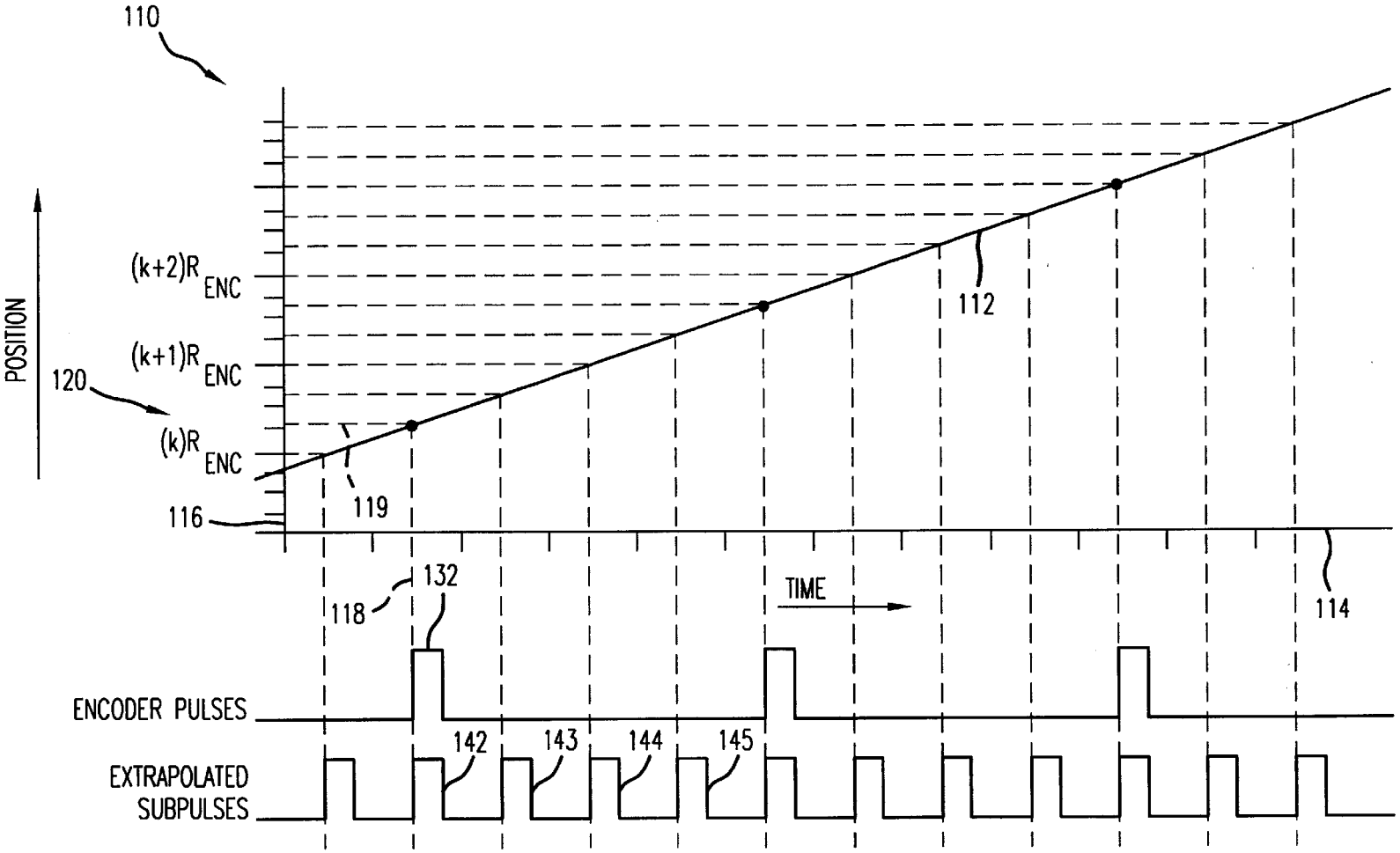
FIG. 2 is a graphical representation of a first order velocity position profile of a carriage unit of FIG. 1, illustrating corresponding encoder pulses and sub-pulses generated from such a profile.
Figure 3:
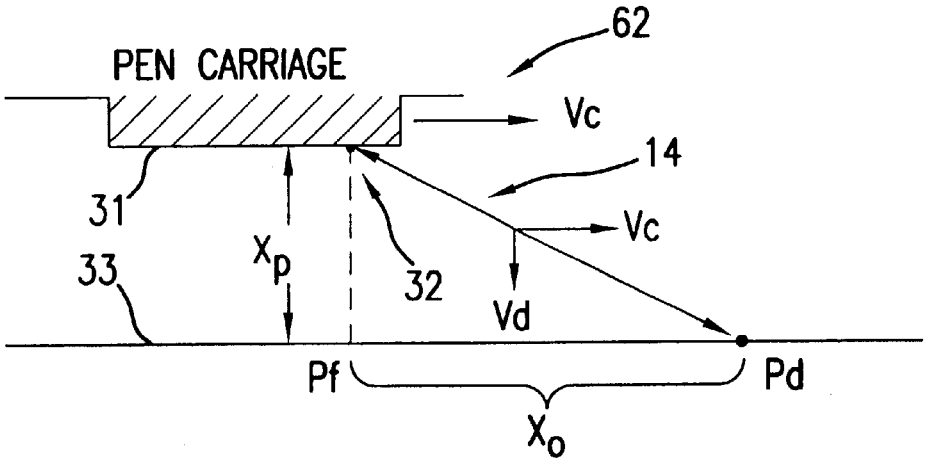
FIG. 3 is a diagrammatic representation of a dot position error induced by carriage velocity.

Considering now the correction method in greater detail, FIG. 2, illustrates a first order position profile 110 of the carriage unit 62 and corresponding encoder pulses and sub-pulses generated from the sensor 64 and the timing module 72 respectively. The position profile 110 is plotted relative to a horizontal axis 114 indicative of time and a vertical axis 116 indicative of distance or position.

The constant velocity of the carriage unit 62 is represented by a straight sweep line 112 that is plotted relative to the time axis 114 and the position axis 116. Each time the carriage unit 62 position sensor 64 passes an encoder boundary, such as an encoder boundary representations indicative of the boundary positions $(k)R_{ENC}$, $(k+1)R_{ENC}$, and $(k+2)R_{ENC}$) an encoder pulse is generated, such as an encoder pulse 132. In response to each encoder pulse 132, the timing module 72 generates a series of sub-pulses, such as the sub-pulses 142–145. By extending imaginary lines, such as the imaginary line 118 from the leading edge of each of the sub-pulses, to the sweep line 112 and then horizontally by another imaginary line, such as an imaginary line 119 position locations can be determined. In the present explanation of the current invention, the sub-pulse interval has been established at one fourth of that of the encoder boundaries. Those skilled in the art will appreciate that other interval time period may also be employed without distracting from the true scope and spirit of the present invention.

Because velocity is constant, the spacing between the encoder pulses 132 and the sub-pulses 142–145 is fixed at constant time intervals.

When the sub-pulses as illustrated in FIG. 2 are utilized to fire ink droplets from the pen 31, the drops will be fired when the pen carriage unit 62 is positioned at regularly space intervals with the carriage position profile mapped to the n-order polynomial. In short then, using this technique, drop placement on the print medium 33 is more accurate and thus, will more readily help hide visual print artifacts induced by printing during different carriage speeds.

Consider the following, if the carriage unit 62 is traveling as some velocity V, and the flight time of the drop is t, the actual drop position will occur at a distance $X_o$ where the distance $X_o$ is derived from Equation 3 as follows:

$$\text{Distance}=X_o=\text{velocity }(V)*\text{time }(t) \qquad \text{Equation 3}$$

The distance $X_o$, ignoring air resistance and other environmental complexities is otherwise known as flight path error. It can be seen that if the carriage velocity is not constant during printing, the positional error will vary and may well induce visible print artifacts. The present invention also solves this positional error problem.

Referring to FIG. 3, the concept of carriage velocity induced dot position errors will be considered in greater detail. As indicated in FIG. 3, the distance $X_{pps}$ is the vertical distance between the nozzle plates of the pens 31 carried by the carriage unit 62 and the medium upon which the ejected droplets will be placed. Assuming ideal conditions with no air resistance, the dot position $P_d$ is given by equation 16 as follows:

$$P_d=P_f+V_ct=P_f+V_c(X_{pps}/V_d) \qquad \text{Equation 4}$$

Where $P_f$ is the position at which the droplet was fired.

$P_d$ is the medium position of the fired droplet.

$X_O$ is the induced error in dot position.

$V_d$ is the drop velocity in a vertical path of travel.

$V_c$ is the carriage velocity $X_{pps}$ is the distance from the pen to the medium surface From equation 4, one can determine that: $P_d=P_f+X_o$, and that $X_o=V_c(d/V_d)$.

If correction is required to make the dot position at $P_f$, the new firing position, equals the error, $P_f^*$ before $P_f$ is given by Equation 5 as follows:

$$P_f^*=X_o=V_c(X_{pps}/V_d) \qquad \text{Equation 5}$$

If the velocity is changing, the uncorrected dot position error $X_O$ changes as well, so that the spacing between dots will vary across the printing medium 33, potentially inducing a visible print artifact.

By employing a firing lead-time based on the current carriage position and velocity, the spacing between the dot on the printing medium 33 can be substantially controlled to provide uniform spacing, even during printing with a varying carriage velocity.

Considering now the correcting of errors in dot position induced by a changing carriage velocity in greater detail with reference to FIG. 10, it can be visually seen in FIG. 10 that as droplets are fired at regularly spaced position intervals when the pen carriage unit 62 slows down, results in induced errors. In this regard, the induced error in dot position is seen as a varying spacing between adjacent dots deposited on the printing medium 33. As shown in phantom line is a corrected position for firing (at an earlier time) based on the horizontal velocity of the carriage unit 62. Ideally, the adjacent ink droplets or dots deposited on the printing medium 33 should be evenly spaced apart from one another. FIG. 10 clearly illustrates that the amount of lead-time correction is proportional to the horizontal carriage velocity.

Drop positional errors are corrected in real time by adjusting the time at which each drop is fired. Correction takes place at the hardware level so it is transparent to the controlling firmware. In this regard, when the pen carriage 62 is traveling at high speed, drops are automatically fired earlier. Conversely, when the pen carriage 62 is traveling at low speeds, less lead-time is needed so the firing time is delayed. The lead time values are a function of the velocity, so monitoring the velocity enables a lead time value to be either calculated from this velocity, or the velocity can be utilized as an index value into a lookup table to get the lead time. In a simple example that ignores the effects of air, the lead-time is a linear function of the velocity. In the real world however, a more complicated function or a lookup table proves to provide a more accurate solution.

Figure 9:
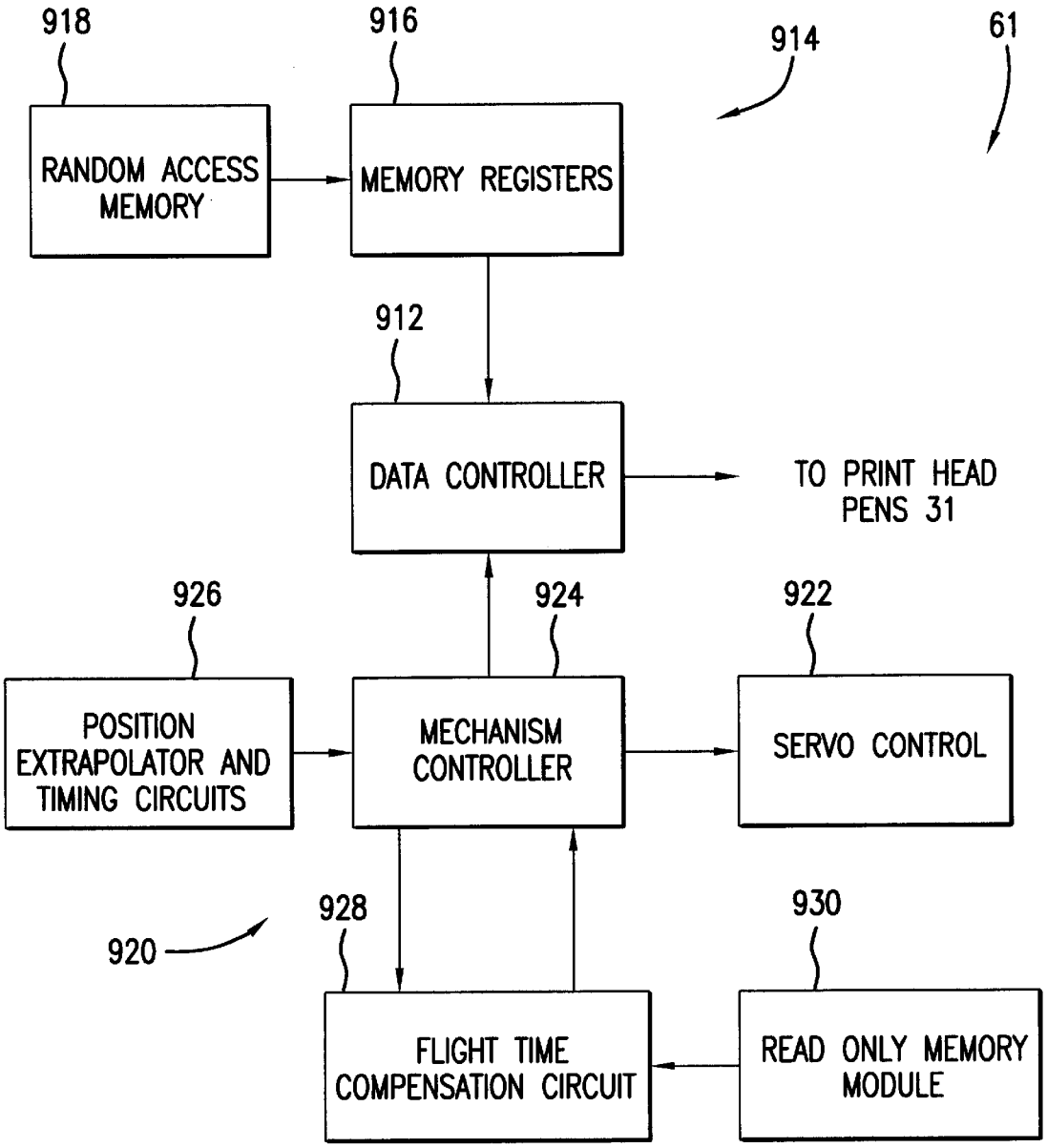
FIG. 9 is a generalized block diagram of a pen-firing module forming part of the printing system of FIG. 1.

Considering now the pen firing circuit 61 in greater detail with reference to FIG. 9, the pen firing circuit 61 generally includes a data controller 912 that generates corrected data for the print head pens, such as the print head pens 31. The data controller 912 is coupled between a memory system indicated generally at 914 and a printer control system 920 that will be described hereinafter in greater detail.

Considering now the memory system 914 in greater detail with reference to FIG. 9, the memory system 914 provides the data controller 912 with the drop data for facilitating the firing of the pens 31. In this regard, the memory system 914 generally includes a set of memory registers 916 and a random access memory module 918 that loads the memory registers 916 with dot data.

Considering now the printer control system 920 in greater detail with reference to FIG. 9, the printer control system 920 generally includes a servo control module 922 that controls the movement of the pen carriage 62 along its path of travel. The servo control module 922 responds to input data generated by a mechanism controller 924 that also provides the data controller 912 with offset information.

In order for the mechanism controller 924 to generate the correct offset data, the mechanism controller 924 is coupled to a position extrapolator and timing module 926. The position extrapolator and timing module 926 provides the mechanism controller 924 with timing data and position information indicative of the position of the carriage 62 as it is traveling along its path of travel.

The mechanism controller 924 using the position information and time data calculates the carriage speed that is coupled to a flight time compensator module 928. The flight time compensator module 928 is coupled to a read only memory module 930 that provides mech specific data to facilitate the calculation of the offset values. That is, the flight time compensator 928 using the current velocity or speed of the carriage 62 and the mech specific data from the read only memory module 930, calculates the offset values that are coupled to the data controller 912 via the mechanism controller 924.

Figure 5:
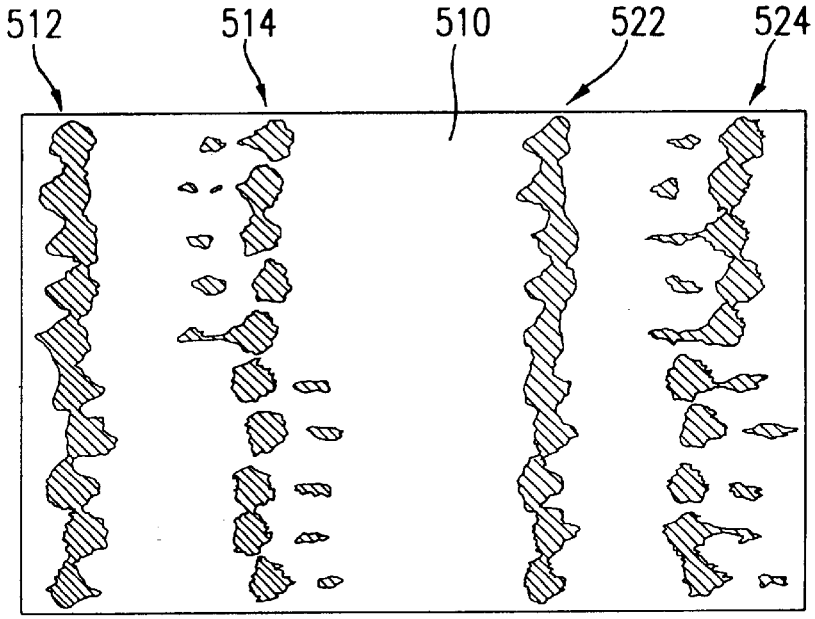
FIG. 5 is a diagrammatic illustration of different types of ink drop impact shapes with different carriage velocity speeds.

Considering the effect of dot correction in greater detail with reference to FIG. 5, a sheet of print medium 510 has disposed thereon a pair of dot columns 512 and 514 respectively. The columns 512 and 514 depict ink droplets patterns formed by droplets being fired at a carriage velocity of about 10 inches per second and about 40 inches per second respectively.

By applying a conventional prior art linear alignment algorithm, the ink droplets in column 512 appears somewhat aligned, while the ink droplets in column 514 appear spread out across the sheet of print medium 510.

Also as best seen in FIG. 5 another pair of dot columns 522 and 524 are illustrated that depict ink droplet patterns formed by droplets being fired at the earlier mentioned carriage velocity of about 10 inches per second and about 40 inches per second respectively. The droplet columns 522 and 524 however are formed applying the linear alignment algorithm of the present invention. It can thus be seen how the low speed columns 512 and 522 are substantially the same regardless of applying the prior art linear alignment algorithm or the improved linear algorithm of the present invention. Conversely, however, the high speed columns 514 and 524 are substantially different. That is, column 524 formed by applying the improved linear alignment algorithm of the present invention, results in a much improved alignment of the column ink droplets as compared to column 514.

While particular embodiments of the present invention have been disclosed, it is to be understood that various different modifications are possible and are contemplated within the true spirit and scope of the appended claims. Thus for example, a look up table could be made available that includes data that is indicative of flight path delay profiles as a function of carriage velocity. In such a configuration, the measured carriage velocity would be utilized to index a delay value retrievable from the lookup table. The advantage of this approach is that highly complex delay functions may be represented in the lookup table without adding any substantial cost to the system. It will be understood therefore that the foregoing disclosure is intended to be merely exemplary, and not to limit the scope of the invention which is to be determined by reference to the appended claims.

We claim:

1. A printing apparatus, comprising:

a pen carriage assembly for ejecting droplets of ink onto a print medium, said pen carriage assembly including a sensor for detecting the position of the pen carriage assembly as it travels along a rectilinear path of travel above the print medium; and a timing module responsive to a series of encoder pulses generated by said sensor generates an estimated polynomial equation of a second order to approximate a dot size profile of ink drops deposited onto the print medium as said pen carriage assembly travels along said path of travel.

2. A printer according to claim 1 further comprising a pen firing module responsive to said series of sub-pulses for improving dot placement inaccuracies induced by said pen carriage assembly travelling at non uniform velocity rates.

3. A printer according to claim 1 further comprising a pen firing module responsive to said series of sub-pulses for improving dot placement inaccuracies induced by said pen carriage assembly travelling at a uniform velocity rate.

4. A printing apparatus, comprising:

a pen carriage assembly for ejecting droplets of ink onto a print medium, said pen carriage assembly including a sensor for detecting the position of the pen carriage assembly as it travels along a rectilinear path of travel above the print medium;

a timing module responsive to a series of encoder pulses generated by said sensor generates a series of sub-pulses that represent estimates of when said pen carriage assembly will be at small increments in position based on the past behavior of the pen carriage assembly relative to its velocity; and a pen firing module responsive to said series of sub-pulses generates nozzle firing pulses for improving dot placement inaccuracies induced by said pen carriage assembly as it travels along said rectilinear path of travel.

5. A printing method for ejecting droplets of ink onto a print medium under uniform carriage velocity conditions, comprising:

detecting the position of a pen carriage assembly as it travels along a rectilinear path of travel above the print medium;

generating a series of sub-pulses that represent estimates of when said pen carriage assembly will be at small increments in position based on the past behavior of the pen carriage assembly relative to its velocity and acceleration factors; and generating nozzle-firing pulses in response to said series of sub-pulses for improving dot placement inaccuracies induced by said pen carriage assembly as it travels along said rectilinear path of travel.

6. A printing apparatus, comprising:

a pen carriage assembly for ejecting droplets of ink onto a print medium, said pen carriage assembly including a sensor for detecting the position of the pen carriage assembly as it travels along a rectilinear path of travel above the print medium; and a timing module responsive to a series of encoder pulses generated by said sensor for generating a linear approximation to approximate a dot size profile of ink drops deposited onto the print medium as said pen carriage travels along said path of travel at a low velocity of between about 0 inches per second and about 20 inches per second and for generating an estimated polynomial equation of a second order to approximate a dot size profile of ink drops deposited onto the print medium as said pen carriage assembly travels along said path of travel at a high velocity of between about 20 inches per second and about 40 inches per second.

7. A dot shape compensation method for use in a printing apparatus, comprising:

detecting the position of a pen carriage assembly as it travels along a rectilinear path of travel above a sheet of print medium; and generating an estimated polynomial equation of a second order to approximate a dot size profile of ink drops in order to compensate for ink drop distortions induced at higher carriage velocities as opposed to lower carriage velocities.

8. A dot shape compensation method for use in a printing apparatus according to claim 7, further comprising:

firing a ink ejecting unit carried by a pen carriage assembly in accordance with the generated estimated polynomial equation.

9. A dot shape compensation method for use in a printing apparatus, comprising:

detecting the position of a pen carriage assembly as it travels along a rectilinear path of travel above a sheet of print medium; and generating a linear approximation to approximate a dot size profile of ink drops deposited onto the print medium as said pen carriage travels along said path of travel at a low velocity;

generating an estimated polynomial equation of a second order to approximate a dot size profile of ink drops deposited onto the print medium as said pen carriage assembly travels along said path of travel at a high velocity of between about 20 inches per second and about 40 inches per second; and firing a ink ejecting unit carried by said pen carriage assembly in accordance with the generated equations.

10. A method of dot shape compensation in accordance with claim 9, wherein said low velocity is between about 0 inches per second and about 20 inches per second.

11. A method of dot shape compensation in accordance with claim 10, wherein said high velocity is between about 20 inches per second and about 40 inches per second.

* * * * *